US009546331B2

(12) United States Patent
Macris

(10) Patent No.: US 9,546,331 B2
(45) Date of Patent: Jan. 17, 2017

(54) HYDROCRACKING PROCESS INTEGRATED WITH VACUUM DISTILLATION AND SOLVENT DEWAXING TO REDUCE HEAVY POLYCYCLIC AROMATIC BUILDUP

(71) Applicant: SHELL OIL COMPANY, Houston, TX (US)

(72) Inventor: Aristides Macris, The Woodlands, TX (US)

(73) Assignee: Shell Oil Company, Houston, TX (US)

( * ) Notice: Subject to any disclaimer, the term of this patent is extended or adjusted under 35 U.S.C. 154(b) by 0 days.

(21) Appl. No.: 14/887,360

(22) Filed: Oct. 20, 2015

(65) Prior Publication Data

US 2016/0115403 A1 Apr. 28, 2016

Related U.S. Application Data

(60) Provisional application No. 62/066,937, filed on Oct. 22, 2014.

(51) Int. Cl.
*C10G 67/02* (2006.01)
*C10G 67/04* (2006.01)

(52) U.S. Cl.
CPC ..... *C10G 67/02* (2013.01); *C10G 67/049* (2013.01)

(58) Field of Classification Search
CPC ..... C10G 67/02; C10G 67/049; C10G 2300/4081
See application file for complete search history.

(56) References Cited

U.S. PATENT DOCUMENTS

| | | | | |
|---|---|---|---|---|
| 3,619,407 | A | 11/1971 | Hendricks et al. | |
| 4,440,633 | A | 4/1984 | Jacquin et al. | |
| 4,447,315 | A | 5/1984 | Lamb et al. | |
| 4,514,287 | A | 4/1985 | Ikematsu et al. | |
| 4,698,146 | A * | 10/1987 | Gruia | C10G 67/049 208/100 |
| 4,810,367 | A | 3/1989 | Chombart et al. | |
| 5,277,793 | A | 1/1994 | Bezman et al. | |
| 5,358,917 | A | 10/1994 | Van Veen et al. | |
| 5,464,526 | A * | 11/1995 | Saunders | C10G 67/06 208/108 |
| 6,096,191 | A | 8/2000 | Kalnes | |
| 6,174,430 | B1 | 1/2001 | Winquist et al. | |
| 6,451,197 | B1 | 9/2002 | Kalnes | |
| 7,192,900 | B2 | 3/2007 | Creyghton et al. | |
| 7,214,308 | B2 | 5/2007 | Colyar | |

(Continued)

FOREIGN PATENT DOCUMENTS

| | | |
|---|---|---|
| FR | 2970478 | 7/2012 |
| GB | 1121786 | 7/1968 |

(Continued)

*Primary Examiner* — Randy Boyer
*Assistant Examiner* — Juan Valencia
(74) *Attorney, Agent, or Firm* — Charles W. Stewart

(57) ABSTRACT

An integrated hydrocracking, vacuum distillation and solvent deasphalting process that provides for controlling the amount of polycyclic aromatic hydrocarbons in a heavy oil recycle stream by separating a portion of the heavy oil recycle stream into various fractions in a vacuum distillation unit, and processing the various fractions in a manner, including solvent deasphalting, that allows for the control of the polycyclic aromatic hydrocarbons in the heavy oil recycle stream.

11 Claims, 1 Drawing Sheet

(56) References Cited

U.S. PATENT DOCUMENTS

| | | | |
|---|---|---|---|
| 7,611,689 | B2 | 11/2009 | Creyghton et al. |
| 7,749,373 | B2 | 7/2010 | Hansen et al. |
| 8,287,720 | B2 | 10/2012 | Baldassari et al. |
| 8,658,030 | B2 | 2/2014 | Osaheni et al. |
| 2014/0238898 | A1 | 8/2014 | Gillis et al. |

FOREIGN PATENT DOCUMENTS

| | | |
|---|---|---|
| WO | 2009003634 | 1/2009 |
| WO | 2011171705 | 6/2011 |

* cited by examiner

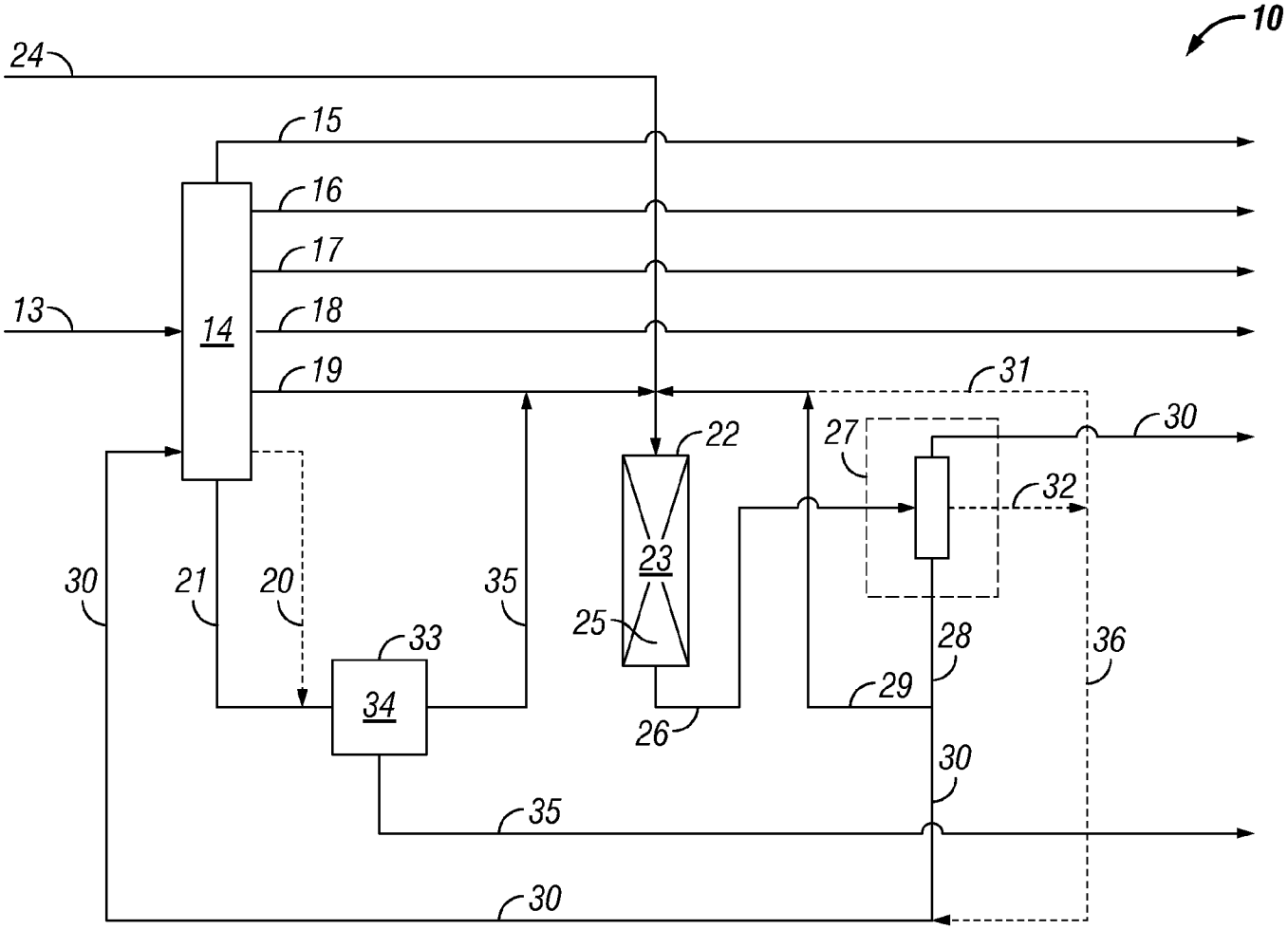
10
14
15
16
17
18
19
20
21
22
23
24
25
26
27
28
29
30
31
32
33
34
35
36
13

HYDROCRACKING PROCESS INTEGRATED WITH VACUUM DISTILLATION AND SOLVENT DEWAXING TO REDUCE HEAVY POLYCYCLIC AROMATIC BUILDUP

The present application claims priority to U.S. Provisional Application No. 62/066,937, filed on Oct. 22, 2014, the disclosure of which is incorporated herein by reference in its entirety.

FIELD OF THE INVENTION

This invention relates to a hydrocracking process that is integrated with the use of vacuum distillation and solvent deasphalting to reduce the buildup of polycyclic aromatic (PCA) hydrocarbons in the heavy oil recycle stream of the hydrocracking process.

BACKGROUND OF THE INVENTION

The hydrocracking process is used to upgrade heavy oil fractions or feedstocks, such as heavy atmospheric gas oil, atmospheric resid, and vacuum gas oil, obtained from crude oil to more valuable lower molecular weight or lower boiling products, such as diesel, kerosene and naphtha. The heavy oil fraction that is typically hydrocracked comprises hydrocarbon components boiling above 290° C. (550° F.) with at least 90 weight percent of the heavy oil fraction boiling above 380° C. (716° F.). The heavy oil fraction may also contain asphaltene and polycyclic aromatic (PCA) hydrocarbon components. A typical heavy feedstock has an initial boiling point above about 315° C. (600° F.) and a final boiling point below about 590° C. (1094° F.).

Hydrocracking is accomplished by contacting in a hydrocracking reaction vessel or zone the heavy feedstock with a suitable hydrocracking catalyst under conditions of elevated temperature and pressure in the presence of hydrogen so as to yield the upgraded products. The product upgrading is accomplished by cracking the larger hydrocarbon molecules of the heavy feedstock and adding hydrogen to the cracked molecules to yield lower molecular weight molecules.

The per-pass conversion across the hydrocracker reactor of the heavy feedstock depends on a variety of factors, including, for example, the composition of the heavy feedstock, the type of hydrocracking catalyst used, and the hydrocracker reactor conditions, including, reaction temperature, reaction pressure and reactor space velocity.

The hydrocracker reactor product is passed to a separation system that typically includes a fractionator or stripper that provides for separating the hydrocracker reactor product to yield at least one lower boiling conversion product and a fraction which comprises the portion of the heavy feedstock that is not converted to lower boiling products. The fraction of heavy feedstock that is not converted can include polycyclic aromatic (PCA) hydrocarbons and asphaltenes contained in the heavy feedstock and PCA hydrocarbons that are formed as side products during the hydrocracking of the heavy feedstock. The separated fraction of unconverted heavy feedstock may be returned as a heavy oil recycle feed to the hydrocracker reactor.

One problem that is sometimes encountered in the processing of certain types of heavy and aromatic hydrocracker feedstocks is that the higher severity hydrocracker reactor conditions needed to provide for a desired high conversion can result in formation of PCA hydrocarbon side products that accumulate in the heavy oil recycle stream of the process. Additionally, in order to achieve the desired conversion of certain heavy hydrocracker feedstocks, the rate of heavy oil recycle often needs to be higher than that typically required when processing other types of feedstock. The combination of the formation of PCA hydrocarbons and higher recycle rates can cause an undesirable buildup of PCA hydrocarbons in the heavy oil recycle stream. This buildup can cause numerous problems in the operation of a hydrocracking process, such as, for example, increasing the rate of catalyst deactivation, reducing conversion yields, and causing equipment fouling.

A number of methods have been proposed in the prior art to prevent the undesirable buildup of PCA hydrocarbons (also referred to as polynuclear aromatics or PNAs) in a heavy oil recycle stream. One such method involves taking a small bleed stream of a polynuclear aromatic compound-rich condensate of the reactor effluent and discarding it (U.S. Pat. No. 3,619,407). However, this approach will result in the loss of valuable lower boiling hydrocarbons, since the bleed stream containing unconverted hydrocarbons is discarded instead of being converted.

Another approach to solving the problem of PNA hydrocarbon build-up in the heavy oil recycle stream is disclosed in U.S. Pat. No. 4,447,315 which involves passing a heavy PNA-containing recycle stream produced by fractionating the liquid phase material recovered from the reactor effluent through a suitable bed of activated carbon or alumina. This method requires the disposal of PNA contaminated adsorbents which is relatively expensive and challenging from an environmental standpoint.

U.S. Pat. No. 4,698,146 discloses a hydrocracking process in which a large portion of the PNAs are recovered in the slack wax stream of a vacuum distillation unit which is said to make the bottoms stream from the vacuum distillation unit more suitable for upgrading in a solvent deasphalting unit. The low value PNA-containing slop wax stream is isolated from any subsequent introduction into the hydrocracking reaction zone, which results in the loss of some of the higher boiling hydrocarbons which are not converted.

Accordingly, there is a continuing need for an improved hydrocracking process that provides for the high conversion hydrocracking of heavy hydrocarbon feedstocks and the reduction of buildup of heavy poly-aromatic hydrocarbons in the heavy oil recycle stream of the hydrocracking process.

SUMMARY OF THE INVENTION

The inventive hydrocracking process provides for both the high conversion of heavy hydrocarbon feedstocks and for a reduction in the buildup of heavy polycyclic aromatic hydrocarbons in a heavy oil recycle stream of the hydrocracking process. The inventive process comprises hydrocracking in a hydrocracker reactor a heavy feedstock to yield a hydrocracked product that is separated into at least two product streams including the heavy oil recycle stream, comprising a concentration of polycyclic aromatic hydrocarbons (PCA hydrocarbons). The PCA hydrocarbons-containing heavy oil recycle stream is divided into two portions, the first portion of which is recycled as feed to the hydrocracker reactor, while a second portion of the heavy oil recycle stream is passed to a vacuum distillation unit (also referred to herein as a "VDU" or a "vacuum tower"). In the vacuum distillation unit, the second portion of the heavy oil recycle stream is distilled into one or more light vacuum gas oil streams, a heavier vacuum gas oil stream, a slop oil or slop wax stream (also referred to as a "slop oil/wax" stream or a "slops" stream) and a vacuum resid stream. The heavier vacuum gas oil stream is passed from the VDU to the hydrocracking reactor while the slop oil/wax stream and the vacuum resid stream are passed from the VDU to a solvent deasphalting unit.

It has been surprisingly found that vacuum distillation of the second portion of the heavy recycle oil results in a significant portion of the PCA hydrocarbons being present in the lighter VGO streams. The term "lighter VGO" streams, as used herein, refers the sidecut stream(s) of a vacuum distillation unit taken from a point above the draw-off point of the heavier VGO stream that are passed to the hydrocracker reactor. In accordance with the present invention, a significant portion of the PCA hydrocarbons reduction in the heavy oil recycle stream, is accomplished by not returning the lighter VGO streams to the hydrocracker reactor, unless they are processed in another processing unit to reduce the PCA hydrocarbons. The amount of PCA hydrocarbons present in the heavy recycle oil, especially the heavier PCA hydrocarbons, are also reduced by passing the vacuum resid stream and the slop oil/wax stream from the VCU to a solvent deasphalting unit wherein they are processed to yield a deasphalted paraffinic oil and a heavy asphaltene-containing fraction comprising heavy PCA hydrocarbons. The deasphalted paraffinic oil having a reduced heavy PCA hydrocarbons concentration is passed as a feed to the hydrocracker reactor.

BRIEF DESCRIPTION OF THE DRAWING

FIG. 1 is a simplified process flow diagram of an embodiment of the inventive integrated hydrocracking process.

DETAILED DESCRIPTION OF THE DRAWING

The inventive hydrocracking process is designed to solve some of the problems associated with the formation of PCA hydrocarbons during the hydrocracking of certain heavy feedstocks and the related buildup of these PCA hydrocarbons in the heavy oil recycle stream of the hydrocracker process. This is done by integrating a hydrocracking process with a vacuum distillation unit and a solvent deasphalting unit or system in such a way that a portion of PCA hydrocarbons are removed from the heavy oil recycle stream in each of these units, and that streams from these units may be recycled to the hydrocracker reactor to increase the overall conversion of the heavy feedstocks.

Catalytic hydrocracking is known in the art. There are a wide variety of process flow schemes that provide for the hydrocracking of heavy feedstocks and which include the use of a recycle stream to improve the conversion of the heavy feedstock being processed to lighter products. Examples of various embodiments of and process flows for hydrocracking processes are disclosed in U.S. Pat. No. 6,451,197 and U.S. Pat. No. 6,096,191. These patents are incorporated herein by reference. Neither of these patents deal with problems associated with formation of PCA compounds during the hydrocracking reaction step or their buildup within the heavy oil recycle stream that is separated from the hydrocracked product and recycled to the hydrocracker reactor.

The heavy feedstock that is charged to or introduced into the hydrocracker reactor of the process is a mixture of high boiling point hydrocarbons typically of petroleum or crude oil origin, but it may also be a synthetic oil such as those originating from a tar sand or shale oil. Examples of the types of heavy feedstocks than may be processed by the inventive hydrocracking process include atmospheric gas oil, preferably a heavy cut of atmospheric gas oil, atmospheric residue, and vacuum gas oil, either a light or heavy vacuum gas oil.

The inventive process is particularly suitable for processing heavier feedstocks; since, the higher severity hydrocracker reactor conditions required to provide for the desired conversion of the heavier feedstock tend to cause the formation of the PCA hydrocarbons, and higher heavy oil recycle rates are typically required to provide for the desired conversion of the heavier feedstock.

The heavy feedstock that is processed, as noted above, typically has an initial boiling temperature greater than about 315° C. (600° F.) and an endpoint less than about 590° C. (1094° F.). It is, however, desirable for the heavy feedstock to be a heavier feed; because, greater benefits are realized from the inventive process by processing heavier feeds instead of lighter feeds. Thus, the heavy feedstock preferably has an initial boiling temperature greater than 330° C. (626° F.) or greater than 340° C. (644° F.). The endpoint may also be less than 580° C. (1076° F.) or less than 565° C. (1049° F.). It is also desirable for at least 90 weight percent of the heavy oil fraction to have a boiling temperature above 380° C. (716° F.), preferably above 385° C. (725° F.) and, most preferably, above 390° C. (734° F.).

The heavy feedstock is introduced into the hydrocracking reaction zone of the inventive process. The hydrocracking reaction zone is defined by one or more hydrocracker reactors, which may be any suitable reactor or reactor design known to those skilled in the art. The hydrocracking reaction zone can include one or more beds of hydrocracking catalyst.

The hydrocracking catalyst contained in the hydrocracker reactor can be any suitable hydrocracking catalyst known to those skilled in the art. Generally, the hydrocracking catalyst includes a crystalline zeolite or molecular sieve and a hydrogenation metal component, which may be selected from one or more metals of Group VIII and Group VIB of the Periodic Table. Examples of the potential suitable types of hydrocracking catalyst for use in the inventive process are described in U.S. Pat. No. 6,451,197 and U.S. Pat. No. 6,096,191. Other suitable hydrocracking catalysts are disclosed in U.S. Pat. No. 7,749,373, U.S. Pat. No. 7,611,689, U.S. Pat. No. 7,192,900, U.S. Pat. No. 6,174,430, U.S. Pat. No. 5,358,917 and U.S. Pat. No. 5,277,793. These patents are incorporated herein by reference.

The heavy feedstock is contacted with the hydrocracking catalyst contained in the hydrocracking reaction zone of the hydrocracker reactor in the presence of hydrogen and under suitable hydrocracking reaction conditions. Typical hydrocracking reaction conditions are known to those skilled in the art and are disclosed in the patent art cited herein.

The hydrocracking reaction conditions are set so as to provide a desired conversion of the heavy feedstock and to provide a desired mixture of lighter boiling products. When referring herein to the conversion of the heavy feedstock, what is meant is that a proportion of the heavy, high boiling temperature hydrocarbon molecules of the heavy feedstock is converted by the hydrocracking reaction to lighter, lower boiling temperature hydrocarbon molecules. Specifically, the term "conversion" is defined as the weight percentage of hydrocarbon molecules contained in the heavy feedstock having a boiling temperature at or above 380° C. (716° F.) that is converted to lower boiling temperature molecules having a boiling temperature below 380° C. (716° F.). Typically, the targeted conversion is at least 50%. It is preferred for the conversion of the heavy feedstock to exceed 60%, and, most preferred, the conversion is greater than 75%.

The hydrocracked product from the hydrocracker reactor is passed to a separation system that provides for its separation into one or more product streams comprising lower boiling temperature hydrocarbons, such as, for example, hydrocarbons boiling in the distillate and naphtha boiling ranges, in addition to its separation of the heavier, unconverted hydrocarbons having a boiling temperature at or above 380° C. (716° F.).

The one or more product streams include the converted hydrocarbons having a boiling temperature below 380° C. (716° F.). Such products can include naphtha, which contains hydrocarbons boiling above about 100° C. to less than about 130° C., kerosene, which contains hydrocarbons boiling above about 130° C. to less than about 290° C., and diesel, which contains hydrocarbons boiling above about 290° C. to less than about 380° C.

The separation system can include a single stripper, fractionator, or flash separator that provides for the separation of the hydrocracked product into a lighter hydrocracker product and a heavy oil recycle stream, or the separation system can include a number of various strippers, fractionators, flash separators configured in a variety of arrangements so as to provide for the separation of the hydrocracked product into the one or more light hydrocracker products and a heavy oil recycle stream.

The heavy oil recycle stream that is yielded from the separation system contains heavy polycyclic aromatic hydrocarbons that are formed during the hydrocracking of the heavy feedstock, and it contains unconverted asphaltenes, if any, that are contained in the heavy feedstock charged to the hydrocracker reactor. The concentration of PCA hydrocarbons of the heavy oil recycle stream can depend upon such factors as the type of feedstock processed, the operating severity of the hydrocracker, and the conversion of the heavy feedstock.

The polycyclic aromatic hydrocarbons referred to herein comprises hydrocarbons composed of multiple aromatic rings that are fused, that is, share one or more sides. Polycyclic aromatic hydrocarbons are also are also known as polynuclear aromatics ("PNA"). Thus, the terms "polycyclic aromatic hydrocarbons", "PCA hydrocarbons", "PCAs", "polynuclear aromatic compounds" or "PNAs" are used interchangeably herein to refer to aromatic hydrocarbons having multiple fused aromatic rings. Such PCA hydrocarbons may enter a hydrocracking reaction zone in the feed, but normally are produced in the hydrocracking reaction zone, for example, by condensation of smaller PCAs having 4 to 6 aromatic rings per molecule (referred to herein as "PCA precursors") into larger PCA hydrocarbons having 7 or more aromatic rings, or 9 or more aromatic rings, or even 11 or more aromatic rings, per molecule. Such PCA hydrocarbons include coronenes (7 ring), benzo-coronenes (9 ring), ovalenes (10 ring), di-coronenes (15 ring), coronylovalenes (18 ring) and di-ovalenes (21 ring). PCA hydrocarbons, especially heavy PCA hydrocarbons, are not easily cracked and tend to accumulate in process equipment causing fouling, catalyst deactivation and other problems. The term "heavy PCA hydrocarbons" as used herein, refers to PCA hydrocarbons having 11 or more aromatic rings per molecule.

The asphaltenes referred to herein include molecular components of the heavy feedstock that primarily consist of carbon, hydrogen, nitrogen, oxygen and sulfur atoms, and that are insoluble in n-heptane ($C_7H_{16}$) and soluble in toluene ($C_6H_5CH_3$). Thus, the asphaltene component of the heavy feedstock is the hydrocarbon fraction that precipitates when n-heptane is added to it.

The concentration of PCA hydrocarbons in the heavy oil recycle stream is controlled by the inventive process so that the amount of PCA hydrocarbons in the heavy oil recycle stream is maintained to less than 1,000 ppmw, but, preferably, the concentration is maintained to less than 750 ppmw. More preferably, the concentration of PCA hydrocarbons in the heavy oil recycle stream is maintained to less than 500 ppmw, and, most preferably, it is less than 250 ppmw.

While any suitable method known to those skilled in the art can be used to measure the PCA hydrocarbons concentration of the heavy oil recycle stream, it has been found that the total concentration of the PCA hydrocarbons of the heavy oil recycle stream can be correlated with its concentration of coronenes. Because of this relationship, the concentration of coronene in the heavy oil recycle stream can alone be measured and correlated with the total concentration of PCA hydrocarbons in the heavy oil recycle stream and used as the control parameter instead of the total PCA hydrocarbons concentration.

When the coronene concentration is used as the control parameter, the amount of coronene in the heavy oil recycle stream is maintained to less than 750 ppmw. Preferably, the concentration of coronene in the heavy oil recycle steam is maintained to less than 500 ppmw, more preferably, to less than 300 ppmw, and, most preferably, to less than 150 ppmw.

In prior art hydrocracking processes, the heavy oil recycle stream is recycled or returned as a feed to the hydrocracker reactor. However, in the processing of the types of heavy feedstocks and under the severe hydrocracking conditions contemplated by the inventive hydrocracking process, it is expected that a buildup of PCA hydrocarbons will occur in the heavy oil recycle stream to such a concentration level that it causes a number of problems if not addressed. For one, the higher concentration of the PCA hydrocarbons in the heavy oil recycle stream can lead to deactivation of the hydrocracking catalyst, reduction in conversion yields, and equipment fouling. Efforts to offset the negative effects of the higher PCA hydrocarbons concentrations in the heavy oil recycle stream by lowering hydrocracker reactor severity can result in an undesirable reduced conversion of the heavy feedstock charged to the hydrocracker reactor.

To solve some of these problems, a bleed or slip stream taken from the heavy oil recycle stream, also referred to herein as a second portion of the heavy oil recycle stream, is passed to a vacuum distillation unit (VDU) wherein it is distilled, typically with the heavy feedstock to VDU, into one or more light vacuum gas oil streams, a heavier vacuum gas oil stream, a slop oil or slop wax stream (also referred to as a "slop oil/wax" stream or "slops" stream) and a vacuum resid stream.

The lighter VGO streams (i.e., those sidecut stream(s) in a vacuum distillation unit taken from a point above the draw-off point of the VGO stream passed to the hydrocracker reactor) have been unexpectedly found to contain relatively large amounts of PCA hydrocarbons. Accordingly, an important feature of the inventive process is that a significant portion of the PCA hydrocarbons reduction in the heavy oil recycle stream is accomplished by not returning the lighter VGO streams to the hydrocracker reactor, unless they are further processed to reduce the PCA hydrocarbons.

The heavier vacuum gas oil stream is passed from the VDU to the hydrocracking reactor while the "slops" stream and the vacuum resid stream are passed from the VDU to a solvent deasphalting unit wherein they are processed to yield a deasphalted paraffinic oil and a heavy asphaltene-containing fraction comprising a portion of the PCA hydrocarbons, especially heavy PCA hydrocarbons. The deasphalted paraffinic oil having a reduced concentration of PCA hydrocarbons is recycled as feed to the hydrocracker reactor, while the heavy asphaltene and PCA hydrocarbon-containing fraction from the solvent deasphalting unit exits the hydrocracker process system and is passed downstream for further processing or as a product.

Any suitable vacuum distillation unit or vacuum tower known to those skilled in the art may be used to a separate heavy hydrocarbon feedstock and PCA hydrocarbon-containing heavy oil recycle stream into appropriate fractions as previously described. Vacuum distillation units normally operate at a reduced pressure well below atmospheric pressure and are used to separate a heavy feedstock, such as the residue from the bottom of a crude oil distillation unit, into various fractions or streams, including one or more light vacuum gas oil (VGO) streams, one or more heavy vacuum gas oil (VGO) streams, a vacuum residuum or resid stream and a slop oil/wax stream. The slop oil/wax stream generally includes those materials boiling at a temperature between the heavy VGO stream(s) and the vacuum resid stream.

Any suitable solvent deasphalting system known to those skilled in the art may be used to provide for the solvent deasphalting of the PCA hydrocarbon-containing vacuum resid and slop oil/wax streams from the vacuum distillation unit to yield the deasphalted paraffinic oil having a reduced PCA hydrocarbons content.

In one suitable method of solvent deasphalting of a heavy oil, a light solvent such as a butane or pentane hydrocarbon is used to dissolve or suspend the lighter hydrocarbons so as to allow the asphaltenes or PCAs to be precipitated. The resulting phases then are separated and the solvent is recovered.

Examples of various solvent deasphalting and other various processes that use solvent deasphalting are described in U.S. Pat. No. 8,658,030, U.S. Pat. No. 4,810,367, U.S. Pat. No. 4,514,287 and U.S. Pat. No. 4,440,633. These patents are incorporated herein by reference.

U.S. Pat. No. 7,214,308 discloses a process that integrates a solvent deasphalting unit with several ebullated bed reactors so as to provide for the separate processing of a deasphalted oil (DAO), separated from a vacuum residue feed, in an ebullated bed hydrocracking reactor and the separate processing of asphaltenes, separated from the vacuum residue feed, in another, separate ebullated bed hydrocracking reactor. The process does not recycle any of the product resulting from cracking the deasphalted oil. U.S. Pat. No. 7,214,308 is incorporated herein by reference.

Another process that integrates solvent deasphalting with hydrocracking is disclosed in U.S. Pat. No. 8,287,720. In this process, a resid feed is hydrocracked in a first hydrocracker reaction stage to form a first stage effluent and a deasphalted oil fraction resulting from the first hydrocracker reaction stage is hydrocracked in a second, separate hydrocracker reaction stage. The deasphalted oil fraction is not recycled to the first hydrocracker reaction stage. U.S. Pat. No. 8,287,720 is incorporated herein by reference.

The first portion of the heavy oil recycle stream, which may be a part or the entire portion of the heavy oil recycle stream that is not passed to the vacuum distillation unit, passes from the separation system and is charged to the hydrocracker reactor as a recycle feed. By recycling the first portion of the heavy oil recycle stream to the hydrocracker reactor, the unconverted heavy hydrocarbons of the heavy feedstock are converted to lower boiling temperature hydrocarbons and the overall conversion of the heavy feedstock is enhanced.

In order the keep the heavy polycyclic aromatics concentration in the heavy oil recycle stream to an acceptable level, the weight ratio of the second portion of heavy oil recycle stream-to-first portion of heavy oil recycle stream is controlled. By controlling this ratio to within a certain desired range, the concentration of heavy polycyclic aromatics in the heavy oil recycle stream can be maintained or controlled to a level below that which causes a significant reduction in conversion and other problems associated with having a high concentration of heavy polycyclic aromatics in the heavy oil recycle stream.

In the inventive process, the weight ratio of the second portion of heavy oil recycle stream (B) to the first portion of heavy oil recycle stream (A), i.e., the B/A ratio, is typically controlled so as to be less than 0.5. There can be certain economic and other advantages to keeping the B/A ratio as low as possible, so, generally, the lower the B/A ratio can be maintained in order to provide the desired benefits from the reduction in PCA hydrocarbons the better. Thus, the B/A ratio will more usually need to be controlled to less than 0.4 and greater than 0.05 as is required by the specific operation of the hydrocracking process for a given feedstock and conversion requirements. More usually, the B/A ratio is controlled within the range of from 0.1 to 0.35, and, most usually, this ratio is controlled to within the range of from 0.15 to 0.3.

It is also a significant feature of the inventive process for the first portion of the heavy oil recycle stream that is recycled to the hydrocracker reactor, without undergoing vacuum distillation or prior solvent deasphalting, to be a major portion of the heavy oil recycle stream when referring herein to the "major portion" of the heavy oil recycle stream, what is meant is that at least 60 wt. % of the heavy oil recycle stream, preferably at least 70 wt. % of the heavy oil recycle stream, and, more preferably at least 75 wt. % of the heavy oil recycle stream, is recycled to the hydrocracker reactor.

FIG. 1 presents a simplified block flow diagram of an embodiment of the inventive hydrocracking process 10. This process provides for a reduction of the buildup of polycyclic aromatic hydrocarbons in a heavy oil recycle stream of hydrocracking process 10.

A heavy feedstock, such as atmospheric resid, enters vacuum distillation unit 14 by way of conduit 13, whereby it is distilled and separated into various fractions. A heavy oil recycle stream is introduced as a second feed to vacuum distillation unit 14 by way of conduit 30. The source of the heavy oil recycle stream is discussed in detail below.

Vacuum distillation unit 14 provides for separating the heavy feedstock and heavy recycle oil streams into fractions or cuts. The lightest fraction, shown as LVGO in the figure, exits vacuum distillation unit 14 via conduit 15. Other VGO fractions (shown as Cut A, Cut B and Cut C in the figure) exit vacuum tower 14 via conduits 16, 17 and 18, respectively, for further processing or as products. Cut D, which is a heavier VGO fraction than cuts A, B or C, passes through conduit 19 to hydrocracker reactor 22 and is introduced as a feed into hydrocracking zone 23. The slop oil/wax fraction and the vacuum resid fraction exit the vacuum distillation unit by means of conduits 20 and 21, respectively, and are passed to a solvent deasphalting unit 33.

As discussed above, VGO stream 19 (Cut D) from vacuum tower 14 is introduced as feedstock to hydrocracking reaction zone 23 defined by hydrocracker reactor 22.

Optionally, one or more additional heavy hydrocarbon feedstocks, such as heavy atmospheric gas oil or atmospheric resid, can be introduced into the hydrocracker reactor by way of conduit 24. Contained within hydrocracking reaction zone 23 are one or more beds of hydrocracking catalyst 25. The heavy VGO stream from vacuum distillation unit 14 and optional other heavy feedstock along with hydrogen is contacted with hydrocracking catalyst 25 within reaction zone 23 under suitable hydrocracking conditions so as to provide for the cracking of at least a portion of the heavy hydrocarbons into lower boiling hydrocarbons.

A hydrocracked product passes as a hydrocracker reaction effluent from hydrocracker reactor 22 through conduit 26 and is charged to separation system 27. Separation system 27 defines one or more separation zones and provides means for separating the hydrocracker product into at least two product streams that include a heavy oil recycle stream and one or more light hydrocracker products.

The one or more light hydrocracker products may include lower boiling hydrocarbon products comprising hydrocarbons having a boiling temperature below 380° C. (716° F.), such as naphtha, kerosene and diesel. The at least one light hydrocracker product passes from separation system 27 by way of conduit 30 to downstream for further processing or product storage.

The heavy oil recycle stream comprises predominantly heavy hydrocarbons of the heavy feedstock having a boiling temperature at or above 380° C. (716° F.) that pass through hydrocracking reaction zone 23 without being converted to lower boiling hydrocarbons having a boiling temperature below 380° C. (716° F.). This heavy oil recycle stream further comprises the PCA hydrocarbons that are formed during the step of hydrocracking the heavy feedstock within hydrocracking reaction zone 23.

The heavy oil recycle stream exits from separation system 27 through conduit 28. A first portion of the heavy oil recycle stream passes by way of conduit 29 and is introduced to hydrocracking reaction zone 23 as a recycle feed together with hydrogen and optionally another heavy feedstock, that is introduced into hydrocracking reaction zone 23 through conduit 24.

A second portion of the heavy oil recycle stream passes by way of conduit 30 to vacuum distillation unit 14, wherein it is charged and is separated by distillation into the various fractions, including four vacuum gas oil side streams, shown as Cuts A, B, C and D, in the drawing. An important aspect of the inventive method is that Cut C, which has been found to contain a relatively high concentration of PCA hydrocarbons, not be returned to the hydrocracking process. Instead it is used as a bleed stream or passed downstream for further processing or as a product.

The slop oil/wax stream and vacuum resid stream exit vacuum distillation unit 14 through conduits 20 and 21, respectively, and are charged to solvent deasphalting unit 33, which defines a solvent deasphalting zone 34. Solvent deasphalting unit 33 provides means for separating asphaltenes and PCA hydrocarbons, especially heavy PCA hydrocarbons, from these streams to yield a deasphalted paraffinic oil that is substantially depleted of PCA hydrocarbons and an asphaltene- containing stream enriched in PCA hydrocarbons. The deasphalted paraffinic oil that is substantially depleted in PCA hydrocarbons passes from solvent deasphalting unit 33 through conduit 35 and is recycled as a feed to hydrocracker reactor 22. The asphaltene-containing stream enriched in PCA hydrocarbons passes from solvent deasphalting unit 33 through conduit 35 to either further processing or storage.

The weight ratio of the second portion of the heavy oil recycle stream which is passed to vacuum distillation unit 14 via conduit 30 (B) to the first portion of the heavy oil recycle stream which is recycled to hydrocracker reactor 22 (C) is controlled so as to maintain a sufficiently low concentration of PCA hydrocarbons in the heavy oil recycle stream. Typically, this weight ratio second portion (B) to the first portion (A) is controlled so that B/A is less than 0.5.

In another embodiment of the inventive process shown in the figure in dotted lines, a stream having a boiling temperature below 380° C. (716° F.) and containing a relatively high concentration of PCA hydrocarbons is withdrawn from separation system 27 through conduit 32 and is split into two portions. The first portion of this lower boiling PCA hydrocarbon-containing stream passes through conduit 31 and is combined with the first portion of the heavy oil recycle stream that is recycled to hydrocracker 22 via line 29. The second portion of the lower boiling PCA hydrocarbon-containing stream passes through conduit 36 and is combined with the second portion of the heavy oil recycle stream that is passed to vacuum distillation unit 14 via conduit 30.

The following example presents some of the aspects of the invention.

EXAMPLE

In this example the concentrations of PCA hydrocarbons was determined in various streams from a vacuum distillation unit operating on 100% of a heavy oil recycle stream obtained from a hydrocracker reactor. The PCA hydrocarbon concentrations were determined on samples taken from the various streams by taking extracts of the samples using dimethylsulfoxide (DSMO), then analyzing the extracts for the presence of coronene, methylcoronene, ethylcoronene, naphthcoronene and ovalene using high performance liquid chromatography. A coronene standard curve was prepared and the PCA hydrocarbons in the sample was quantified from the linear range of the curve. The PCA hydrocarbon contents of the various VCU streams tested are shown in Table 1, below.

TABLE 1

| Sample | PCA Hydrocarbons, ppmw |
|---|---|
| Heavy oil recycle feed to VCU | 306.5 |
| LVGO | 199.7 |
| Cut A | 45.9 |
| Cut B | 199.7 |
| Cut C | 786.4 |
| Cut D | 470.6 |
| Slops fraction | 207.5 |
| Vacuum resid | 97.2 |

As can be seen from the above data, Cut C, which has a lower boiling point than Cut D, the slops fraction or the vacuum resid fraction, has a surprisingly high PCA hydrocarbons content. It is unexpected that the PCA concentration of the lighter Cut C is significantly greater than the PCA concentration of the heavier fraction of Cut D, slops, and vacuum resid. Thus, an important aspect of the inventive hydrocracking process is controlling the PCA hydrocarbons level in the heavy oil recycle stream by not recycling the VGO streams, such as Cut C, that have the higher PCA hydrocarbons concentrations, to the hydrocracker reactor. This can be done in addition to the PCA hydrocarbon control accomplished by removing heavy PCA hydrocarbons from the heavy oil recycle stream by passing both the slop oil/wax fraction and the vacuum resid fraction to a solvent deasphalting unit.

The foregoing description in the figure and the example are only intended to illustrate the inventive process but are not intended to limit in any way the scope of the invention.

The invention claimed is:

1. A hydrocracking process providing for a reduction of the buildup of polycyclic aromatic hydrocarbons in a heavy oil recycle stream of said hydrocracking process, wherein the process comprises:

(a) hydrocracking in a hydrocracker reactor a heavy feedstock to yield a hydrocracked product that is separated into at least two product streams including said heavy oil recycle stream, comprising a concentration of said polycyclic aromatic hydrocarbons;

(b) passing a first portion of said heavy oil recycle stream as a recycle feed to said hydrocracker reactor;

(c) passing a second portion of said heavy oil recycle stream to a vacuum distillation unit wherein said second portion is separated into at least a light vacuum gas oil stream, a heavier vacuum gas oil stream, a slop oil/wax stream and a vacuum resid stream, and wherein said light vacuum gas oil stream contains a concentration of polycyclic aromatic hydrocarbons greater than the concentration of polycyclic aromatic hydrocarbons in said heavier vacuum gas oil stream;

(d) passing said heavier vacuum gas oil stream as a feed to said hydrocracker reactor;

(e) using said light gas oil stream containing said higher concentration of polycyclic aromatic compounds as a bleed stream or a product stream that is not returned to said hydrocracking process;

(f) passing the slop oil/wax stream and the vacuum resid stream to a solvent deasphalting unit wherein asphaltenes and heavy polycyclic aromatic hydrocarbons are separated from said streams to yield a deasphalted paraffinic oil depleted in polycyclic aromatic hydrocarbons; and (g) passing said deasphalted paraffinic oil depleted in polycyclic aromatic hydrocarbons as a feed to said hydrocracker reactor.

2. A hydrocracking process as recited in claim 1, wherein said hydrocracking process is controlled so as to provide a weight ratio of said second portion of said heavy oil recycle stream to said first portion of said heavy oil recycle stream in the range upwardly to less than 0.5.

3. A hydrocracking process as recited in claim 1, wherein said at least two product streams further includes at least one light hydrocracker product and wherein said at least one light hydrocracked product is separated from said heavy oil recycle stream in a separation system, and a major portion of said heavy oil recycle stream is passed from said separation system to said hydrocracking reactor while a minor portion of said heavy oil recycle stream is passed from said separation system to said vacuum distillation unit.

4. A hydrocracking process as recited in claim 2, wherein said weight ratio of said second portion of the heavy oil recycle stream to said first portion of said heavy oil recycle stream is controlled so as to maintain said concentration of said polycyclic aromatic hydrocarbons to less than 1000 ppmw of said heavy oil recycle stream.

5. A hydrocracking process as recited in claim 1, wherein said least two product streams further includes at least one light hydrocracker product, wherein each of said at least one light hydrocracker product has an end point of less than 380° C. (716° F.).

6. A hydrocracking process as recited in claim 3, wherein the heavy oil recycle stream is the bottom stream from said separation system and comprises predominantly heavy hydrocarbons having a boiling point above 380° C. (716° F.).

7. A hydrocracking process as recited in claim 5, wherein said hydrocracking process provides for a conversion of said heavy feedstock of at least 50%, wherein said conversion is defined as the percentage of the hydrocarbons of said heavy feedstock boiling at or above 380° C. (716° F.) that is converted to hydrocarbons boiling below 380° C. (716° F.), based on the weight of said heavy feedstock.

8. A hydrocracking process as recited in claim 4, wherein said weight ratio of said second portion of the heavy oil recycle stream to said first portion of said heavy oil recycle stream is controlled so as to maintain said concentration of said polycyclic aromatic hydrocarbons to less than 500 ppmw of said heavy oil recycle stream.

9. A hydrocracking process as recited in claim 8 wherein said hydrocracking process is controlled so as to provide a weight ratio of said second portion to said first portion is in the range of from 0.1 to 0.35.

10. A hydrocracking process as recited in claim 9, wherein said weight ratio of said second portion of the heavy oil recycle stream to said first portion of said heavy oil recycle stream is controlled so as to maintain said concentration of said polycyclic aromatic hydrocarbons to less than 250 ppmw of said heavy oil recycle stream.

11. A hydrocracking process as recited in claim 7, wherein said hydrocracking process provides for a conversion of said heavy feedstock of at least 75%.

* * * * *